United States Patent [19]

Jensen et al.

[11] Patent Number: 4,787,816

[45] Date of Patent: Nov. 29, 1988

[54] ROTARY PUMP

[75] Inventors: Niels D. Jensen, Bjerringbro, Denmark; Laszlo Sass, Enghien-les-Bains, France

[73] Assignee: Grundfos International a/s, Bierringbro, Denmark

[21] Appl. No.: 111,688

[22] Filed: Oct. 12, 1987

[30] Foreign Application Priority Data

Oct. 31, 1986 [DE] Fed. Rep. of Germany ..... 3637040

[51] Int. Cl.[4] ..... F01D 25/30

[52] U.S. Cl. ..... 415/168; 55/199; 55/204

[58] Field of Search ..... 415/121 A, 121 R, 168, 415/182, 208; 55/185, 192, 199, 201, 203, 204

[56] References Cited

U.S. PATENT DOCUMENTS

| | | | |
|---|---|---|---|
| 3,290,864 | 12/1966 | Harker et al. | 55/203 |
| 3,308,607 | 3/1967 | Mueller | 55/201 |
| 3,407,569 | 10/1968 | Hendricks | 55/201 |
| 3,976,452 | 8/1976 | Meier et al. | 55/192 |
| 4,331,458 | 5/1982 | Liljestrand | 55/192 X |
| 4,447,189 | 5/1984 | Jensen et al. | 415/168 |
| 4,461,632 | 7/1984 | Banos et al. | 55/201 X |

FOREIGN PATENT DOCUMENTS

| | | | |
|---|---|---|---|
| 1937119 | 2/1971 | Fed. Rep. of Germany . | |
| 3109918 | 10/1982 | Fed. Rep. of Germany . | |
| 643668 | 1/1979 | U.S.S.R. | 415/121 R |

*Primary Examiner*—Robert E. Garrett
*Assistant Examiner*—Joseph M. Pitko
*Attorney, Agent, or Firm*—Balogh, Osann, Kramer, Dvorak, Genova & Traub

[57] ABSTRACT

A rotary circulating pump for heating systems comprises a pump housing with suction and delivery sides separated from one another by an impeller and having a calming or damping chamber situated on the suction side with an integral separator chamber connected thereto for removal of air from the fluid passing through the pump. A flow divider splits the fluid entering into the pump housing into two part flows before they reach the calming chamber. To enhance the separation of air bubbles, the flow divider is so constructed that it imparts to the part flows a rotational motion which is superimposed over their translatory displacement, and deflects the part flows radially as well as axially away from the suction aperture of the pump impeller.

5 Claims, 2 Drawing Sheets

ROTARY PUMP

BACKGROUND OF THE INVENTION

The invention relates to a rotary pump, and more particularly to a circulating pump for heating systems, comprising an air separator formed integrally in the pump housing, with a calming chamber situated on the suction side of the pump with a separator chamber connected thereto for the air which is to be ducted to the outside, and with a flow divider which splits the fluid entering the pump housing into two part flows reaching the calming chamber.

Heating systems can operate properly only if the water to be circulated by the pump is free of air. If there are air bubbles in the delivery flow of the circulating water, there may be flow noises, the bearings of the pump may be damaged by running dry and corrosion problems arise, as well as other drawbacks.

DESCRIPTION OF THE PRIOR ART

A great number of pumps comprising integrated air separators has been developed until now, so that the water may be de-aerated during the circulating action. A first group of such air-separator pumps utilises separators based on the centrifugal principle, e.g. such as described in German Pat. No. 30 22 420, German Utility model No. 81 02 303 and U.S. Pat. No. 3,290,864. A second group of air-separator pumps comprises separators operating on the gravitational principle, e.g. such as described in the German Patent application Nos. 19 37 119 and 31 09 918 and in German Pat. No. 23 46 286.

The air separators operated by the centrifugal principle cause a comparatively great pressure loss and thereby reduce the pump efficiency. The separators operated by the gravitational principle have the disadvantage of poor degrees of separation, diminishing with an increased delivery flow.

The second group of air separator pumps comprise a calming chamber situated before the pump impeller, in which it is attempted to act on the throughflowing water containing air bubbles by means of sieves or the like to remove the air bubbles.

SUMMARY OF THE INVENTION

It is an object of the invention to provide a rotary pump of the kind referred to in the foregoing, in which improved air separation is achieved within the calming chamber.

This object is achieved according to the invention in that the flow divider imparts a rotational motion to the two part flows which is superimposed over their translatory displacement and deflects the part flows radially as well as axially in a direction away from the suction aperature of the pump impeller.

A preferred form of the flow divider has a sloping flow impingement surface. This impingement surface may for example comprise a semi-conical jacket surface the larger radius of which is directed towards the pump impeller. Alternatively, the impingement surface may also comprise a composite surface, that is to say a semi-frustoconical surface and a semicylindrical surface, the frustoconical surface being turned towards the pump impeller and the centreline of the suction stub pipe of the pump intersecting the boundary line between the cylindrical and frustoconical surfaces.

A substantially improved de-aeration of the heating water flowing through the circulating pump is obtained in this way. This may substantially be attributed to the fact that the air bubbles present in the delivery or carrier flow are impelled towards the centre of the twisting motion forcibly induced in the two part flows and are thereby placed at a greater distance from the suction aperture of the pump impeller. Also as a result of this action, they enter the calming chamber in a volume in which the water speed directed towards the pump impeller is lower than the floating speed of the air bubbles, so that these may move upwards into the separator chamber substantially more satisfactorily and reliably as well as more rapidly. It is consequentially a substantial advantage if the two part flows travel farther away from the suction aperture of the pump impeller not only in radial direction, as until now, but also in the axial direction, for the purpose of de-aeration.

Further features and advantages of the invention will become apparent from the following detailed description when read with reference to the accompanying drawings which illustrate a preferred embodiment of the invention.

DETAILED DESCRIPTION OF THE PREFERRED EMBODIMENT

Figure 1:
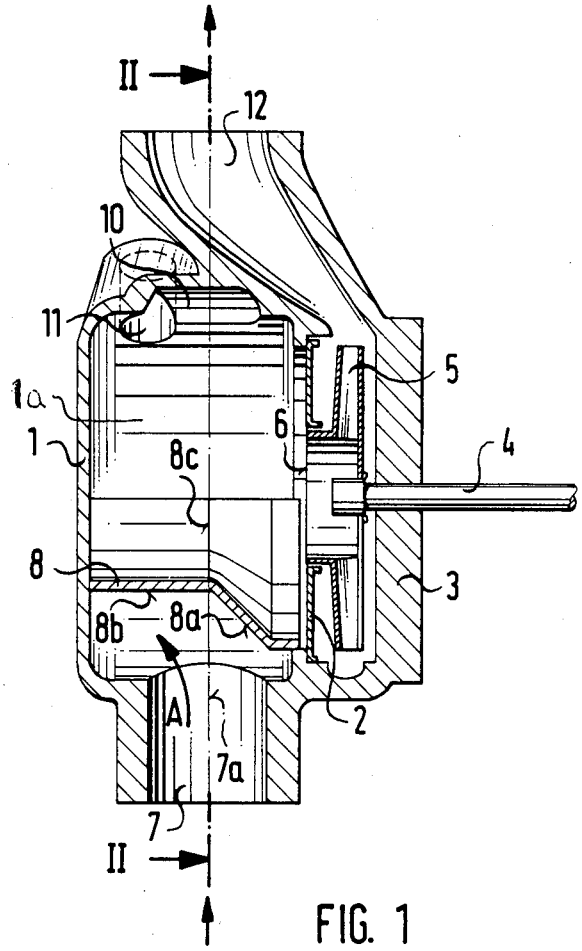
FIG. 1 shows an axial cross-section through a pump in accordance with a first embodiment of the invention and FIG. 2 shows a cross-section along the line II—II in FIG. 1.

The circulating pump shown in both figures is an in-line model such as is commonly used in modern heating systems. The pump comprises a pump housing 1, a partition 2 which divides the internal volume of the housing into the suction and delivery sides, a cover 3 which closes off the housing 1 from its surroundings, a spindle 4 for the driving motor which is not shown herein and is in the form of a submerged motor, and a pump impeller 5 in the form of a rotary runner which is installed on the inward extremity of the spindle 4 in the delivery space of the pump housing.

In a conventional manner, the suction aperture 6, together with the partition 2, forms a contactless gap joint between the suction and delivery sides of the pump housing. A calming or damping chamber is formed within the housing on the suction side of the impeller.

The water of the heating circuit, which is aerated and is to be circulated enters this housing via the suction pipe stub 7 of the pump housing 1 and strikes a flow divider 8 which is located between the pipe 7 and the calming chamber 1*a* and which splits the incoming carrier flow into two part flows 9*a* and 9*b* and by virtue of its conformation generates a twisting motion in each part flow, the two twisting motions being contradirectional with respect to each other.

The flow divider is so constructed moreover that the two part flows are deflected with respect to the suction aperture 6 of the pump impeller, that is to say in such a way that they move away from the suction aperture 6 in an axial direction as shown by the arrow A in FIG. 1.

The particles of fluid of the part flows 9*a*,9*b* are thus displaced helically in each case about a centre of rotation, each centre of rotation coinciding approximately with the centre of the cross-sectional area of the flow channel for the part flows 9*a* and 9*b* formed in each case by the pump housing 1 and the flow divider 8. Because of the axial configuration of the flow divider 8, the longitudinal extension of the centre of rotation of each part flow also describes an axially deflected course. This has the result that the air bubbles of the part flows, which are actually impelled towards the centre of rotation in question as a result of physical laws, are impelled towards the centres of the two flow channels and by virtue of the axial deflection component of the flow channels carrying the part flows, are also placed at a greater distance from the suction aperture of the pump impeller in the axial direction than would be the case without a flow divider 8, or with a conventional flow divider.

Since the speed of the water drawn in by the pump impeller 5 diminishes with the square of the distance from the suction aperture 6 and since the water speed drops to a value below the suspension speed of the air bubbles, the air bubbles no longer reach the pump impeller, 5. They consequently rise into a separator chamber 10 and the air collected therein is drawn off from the pump housing 1 via a venting bore 11. The circulating water which is de-aerated or rather freed of air bubbles, leaves the pump via the conventional delivery stub pipe 12.

Figure 2:
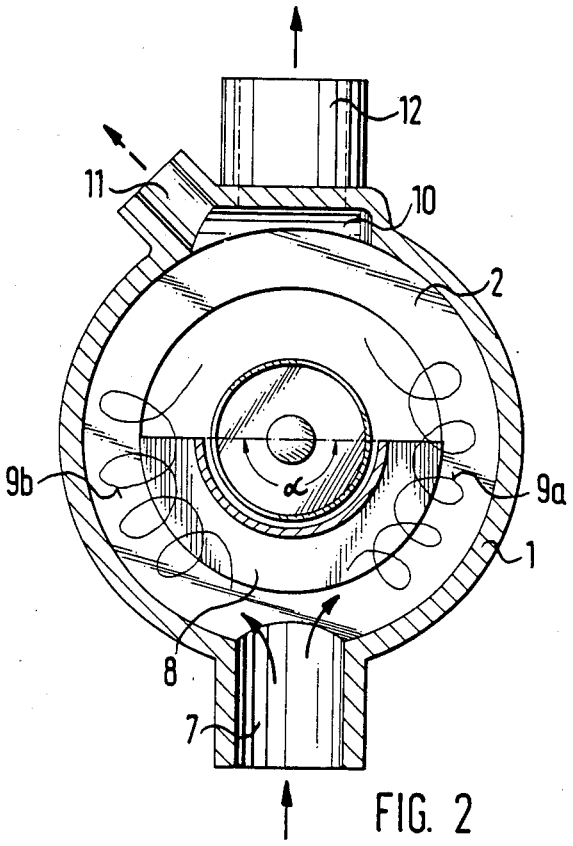

The flow divider 8 may have a variety of forms. As shown in FIGS. 1 and 2, it preferably comprises a half-shell part having a frustoconical surface 8*a* and a cylindrical surface 8*b*, the frustoconical surface facing towards the pump impeller 5 and the centre line 7*a* of the pipe stub 7 intersecting the boundary line 8*c* between the cylindrical and frustoconical surfaces. Furthermore, the flow divider 8 screens off the suction aperture 6 of the pump impeller 5 from the inlet cross-section of the suction pipe stub 7 within an angular spread $\alpha$ this angular spread commonly amounting to between 90° and 240° and preferably to about 180° as a minimum, as shown in FIG. 2. Furthermore, the flow divider 8 has a radial dimension such that the flow cross-section of the flow channels referred to in the foregoing, i.e. the cross-section delimited by the flow limiter on the one hand and by the internal surface of the pump housing on the other hand, is greater than the inlet cross-section of the suction pipe stub 7 of the pump housing. The dimensional ratio amounts to between two and eight, the cross-section of the flow channels preferably and commonly being from about four to six times as great as the flow cross-section of the suction pipe stub.

Tests have shown that a flow divider dimensioned within these limits offers excellent air seaaration efficiency and assures a reliable generation of the part flows having the desired flow parameters, the flow divider having a substantially improved degree of air separation even under unfavourable operating conditions. In other possible embodiments of the flow divider 8, the latter may also be so formed that as seen in cross-section, it also comprises a single frustoconic.al surface of half-shell form, the ratio between the major radius and the minor radius being from about 1.2:1 and 3.0:1 and preferably about 2. Another possible contour shape for the flow divider has the function that the water flow flowing in via the inlet stub pipe 7 is deflected by means of a parabolically or hyperbolically curved outline configuration of the flow divider opposite to the suction aperture 6 of the pump impeller 5. Apart from the alternative outline configurations referred to in the foregoing for the flow divider, other outline contours may also be envisaged by one versed in the art, which ensure that the two part flows 9*a* and 9*b* are deflected axially in the required manner.

What is claimed is:

1. A rotary pump comprising a pump housing with suction and delivery sides;

an impeller within said housing, formed with a suction aperture opening into the suction side of the housing;

a calming chamber on the suction side of the housing;

an air separator integrated in the housing on the suction side and communicating with said calming chamber to remove air from said fluid to the outside;

a fluid inlet to the housing on the suction side; and a flow divider positioned between said fluid inlet and said calming chamber to split the incoming fluid into two partial flows before it reaches said calming chamber, the flow divider being shaped to impart, to the two partial flows, a rotational motion which is superimposed on the translatory displacement of the partial flows and to deflect the partial flows radially in a direction away from the suction aperture of the pump impeller, characterized in that the flow divider is provided with an inclined and curved impingement surface, the larger radius of which is situated towards the pump impeller, so that the partial flows are also deflected axially in a direction away from the said suction aperture.

2. A pump as claimed in claim 1 wherein said flow impingement surface is at least partially conical.

3. a pump as claimed in claim 1, wherein the flow divider comprises a frustoconical surface and a cylindrical surface and wherein said fluid inlet has an axial centre line intersecting a boundary line between said cylindrical and frustoconical surfaces.

4. A pump as claimed in claim 1 wherein the flow cross-section defined between the flow divider and the inner wall of the pump housing opposite thereto is about two to about eight times greater than the cross-section of said fluid inlet.

5. A pump as claimed in claim 1 wherein the flow divider screens off the suction aperture of the pump impeller from the fluid inlet over an angular distance of from about 90° to about 240°.

* * * * *